US011266994B2

(12) United States Patent
Sabol et al.

(10) Patent No.: US 11,266,994 B2
(45) Date of Patent: Mar. 8, 2022

(54) SCREEN DIVERTER AND DUAL COMMINUTOR WITH CONTINUAL OPERATION

(71) Applicant: SULZER MANAGEMENT AG, Winterthur (CH)

(72) Inventors: Rob Sabol, Aliso Viejo, CA (US); Corey Glauberman, Tustin, CA (US)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 16/465,361

(22) PCT Filed: Dec. 21, 2018

(86) PCT No.: PCT/US2018/066993
§ 371 (c)(1),
(2) Date: May 30, 2019

(87) PCT Pub. No.: WO2019/126603
PCT Pub. Date: Jun. 27, 2019

(65) Prior Publication Data

US 2021/0094041 A1 Apr. 1, 2021

Related U.S. Application Data

(60) Provisional application No. 62/609,547, filed on Dec. 22, 2017.

(51) Int. Cl.
*B02C 18/00* (2006.01)
*B02C 18/14* (2006.01)
(Continued)

(52) U.S. Cl.
CPC ..... *B02C 18/0092* (2013.01); *B02C 18/142* (2013.01); *B02C 18/16* (2013.01); *B02C 23/36* (2013.01)

(58) Field of Classification Search
CPC ..... B02C 18/0092; B02C 18/0084; B02C 18/2266; B02C 18/16; B02C 18/142;
(Continued)

(56) References Cited

U.S. PATENT DOCUMENTS 4,961,540 A 10/1990 Wiesemann
5,048,764 A 9/1991 Flament
(Continued)

FOREIGN PATENT DOCUMENTS

EP 0 704 246 A1 4/1996
EP 0 988 896 A2 3/2000
(Continued)

OTHER PUBLICATIONS

Written Opinion for PCT/US2018/066993, dated Mar. 4, 2019.
International Search Report for PCT/US2018/066993, dated Mar. 4, 2019.

*Primary Examiner* — Adam J Eiseman
*Assistant Examiner* — P Derek Pressley
(74) *Attorney, Agent, or Firm* — Sughrue Mion, PLLC

(57) ABSTRACT

A system for comminuting solid waste material including a casing defining a comminution chamber having two side walls and adapted for connection in a solid waste disposal channel. The system includes a first shredding device and a second shredding device disposed along a line extending perpendicular to a flow direction in the channel to form a pair of interactive shredding members. A rotating screening drum disposed within the casing upstream of the first and second shredding devices and positioned between the first and second shredding devices, the rotating screening drum configured to permit fluid to pass therethrough and to move solids toward one of the shredding devices. The rotating screening drum is configured to rotate clockwise and counter
(Continued)

clockwise to alternately distribute solids captured thereon to one of the first and second shredding devices.

15 Claims, 5 Drawing Sheets

(51) Int. Cl.
*B02C 18/16* (2006.01)
*B02C 23/36* (2006.01)

(58) Field of Classification Search
CPC ..... B02C 23/36; B02C 23/16; B02C 23/10; B02C 23/38; B02C 2201/063; B02C 2201/06; B02C 2018/164; F04D 7/045; F04C 2/00; E03F 5/14
See application file for complete search history.

(56) References Cited

U.S. PATENT DOCUMENTS

| | | | | |
|---|---|---|---|---|
| 5,505,388 | A * | 4/1996 | Chambers | B02C 23/08 241/46.02 |
| 5,833,152 | A | 11/1998 | Galanty | |
| 2003/0089806 | A1 * | 5/2003 | Galanty | B02C 18/16 241/46.06 |
| 2011/0084154 | A1 | 4/2011 | Amburgey | |
| 2014/0084095 | A1 | 3/2014 | Glauberman et al. | |

FOREIGN PATENT DOCUMENTS

| | | |
|---|---|---|
| EP | 1 750 844 B1 | 6/2014 |
| WO | 93/14874 A1 | 8/1993 |

* cited by examiner

A - IF COMMINUTOR 1 IS OPERATING FORWARD AGAIN, SCREEN WILL REVERSE INTO A CLOCKWISE ROTATION AND CONTINUE IN SAFE MODE. IF COMMINUTOR 1 IS NOT OPERATING FORWARD, THE SCREEN WILL OPERATE IN CRITICAL MODE AND REVERSE EVERY PREDEFINE TIME.

SCREEN DIVERTER AND DUAL COMMINUTOR WITH CONTINUAL OPERATION

CROSS-REFERENCE TO RELATED APPLICATIONS

This Application is a National Stage of International Application No. PCT/US2018/066993 filed Dec. 21, 2018, claiming priority based on U.S. Provisional Patent Application No. 62/609,547 filed on Dec. 22, 2017 in the U.S. Patent Trademark Office, the disclosure of which is incorporated herein in its entirety by reference.

BACKGROUND OF THE INVENTION

Pump stations are required in municipal wastewater collection systems where terrain does not allow for strictly gravity flow of sewage to a treatment facility. Sewage is typically comprised of water and soluble organics, including human waste, however, it may also contain non-soluble items or solids. Examples of solids include: rags, shoes, articles of clothing, condoms, chunks of asphalt, bits of wood, money, wipes, rocks and many other items that are often flushed down the toilet or washed down the drain by industry and the general public. While lift station pumps are typically able to handle the soluble organics, blockages may occur when solids are too large to pass through pump orifices. This behavior is often referred to as pump "ragging". Pump de-ragging is a costly, labor-intensive and hazardous process, and when those costs become significant, municipalities tend to employ either solids removal or solids reduction equipment to ensure the pump operates efficiently and without disruption.

In the wastewater industry, twin-shafted shredders are common solids reduction devices, however, hydraulic capacity limitations of the basic two-shaft configuration have resulted in the implementation of supplemental solids diverter technologies that aim to pass liquid and soluble organics, while classifying out and directing non-soluble items to the shredder mechanism. There are several incarnations of the solids diverter, including: vertically-oriented screen belts; vertical-axis rotating screen drums; stacks of interlaced rotating disks; mechanically-raked horizontal bar screens, and; even fixed perforated plate screens. Arguably, the most common solids diverter technology is based on the rotating screen drum. In this design, the twin-shafted shredder 10 (FIG. 1, FIG. 2) is flanked by one or more cylindrical screen drums 20. While the cutter stack 25 is operating, the screen drum(s) rotate in such a manner as to transport any solids collected on the face of the cylindrical screen to the cutter stack for particle size reduction.

In order to physically support the twin-shafted cutter stack and the rotating screen drum(s), the bearings/seals at the top and bottom of the rotating component shafts are typically mounted in top and bottom end housings 30. These end housings are typically metal castings, welded metal fabrications or hybrid cast/sheet metal assemblies with machined pockets to hold the bearings. On the side of the drum opposite the cutter stack, a baffle or side rail 70 is used to close the gap between the outside of the machine/channel wall 80 and the screen drum. This side rail provides a connection feature between the machine and the mounting frame 90, inhibits bypass of flow around the screen drum 20, and directs flow to the drum. The side rail is also fitted with a sealing element 110 (e.g., plastic strip or brush) making line contact with the drum at a point on the drum surface suitable to optimize solids capture vs. flow capacity.

While performing its function, the shredder may periodically be presented with solids that may require an unusual amount of cutter force to shred. This condition is manifested when the force required by the cutter stack 25 causes the shredder drive motor 40 to exceed its rated output, or causes the cutter stack to jam and the motor to stall. This motor behavior is monitored using current, or power load sensor(s) when electric motors are used, or pressure sensor(s) when hydraulic motors are used. These sensors are commonly incorporated into a motor controller device (FIG. 3) that acts as a switch for the power provided to the shredder and solids diverter motors. The sensor(s) are connected to a logic controller (FIG. 3), or logic circuit, such that when the sensor(s) detect(s) excessive current or power draw by the motor, the logic controller or logic circuit may de-energize the affected motor to limit damage to that motor and the connected equipment. In designs where logic controllers are used, it is common to implement jam clearing logic that attempts to clear the jam by energizing the shredder motor in its "reverse" direction for a portion of a cutter stack rotation followed by re-energizing the shredder motor in its "forward" direction. This action is completed with the purpose of allowing the cutters an additional opportunity to shred the tough solid(s) that caused the jam. Often, multiple iterations of this jam clearing behavior are executed in order to shred tough material. If, after one, or multiple, jam clearing iterations, the solids remain too tough to shred, the logic controller will typically de-energize the shredder motor and set a fault condition and alert facility personnel. When the shredder is stopped, solids will tend to collect on the upstream side of the grinder. Liquid and soluble material continue to pass through any available openings. Given a sufficient period of time, the shredder will become blinded and an overflow condition may result. This occurs when the liquid upstream of the shredder rises to such a level as to surpass the height of the shredder.

The device's need to shut down for mechanical protection creates an undesirable result at the pump station of facility, especially if only one device is present without a sufficient bypass that will contain the waste stream. In the event of an alert, facility personnel are typically required to investigate the cause, clear the obstruction and Fault condition on the device's controller before restating the equipment. While some shredders may easily be accessed, others may be located in confined spaces, possibly at locations remote to facility personnel. In many cases, removal of the device is required to access and remove the offending material. Removal equipment may not be physically present compounding time to correct the fault condition. Should a device jam occur while personnel are off duty, or are otherwise occupied, an overflow event may occur. Overflow events can be costly to a municipality and dangerous to personal or the local community. Fines by the Environmental Protection Agency may be warranted.

SUMMARY OF THE INVENTION

Aspects of the application relate to a system for comminuting solid waste material including a casing defining a comminution chamber having two side walls and being open on opposite sides thereof for permitting the flow of liquid therethrough bearing solid waste material and being adapted for connection in a solid waste disposal channel. The system includes a first shredding device and a second shredding device disposed along a line extending perpendicular to a flow direction in the channel; each of the first and second shredding devices comprising parallel first and second shredding stacks that include first and second rotating parallel shafts, each of the first and second parallel shafts including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members. The system also includes a rotating screening drum disposed within the casing upstream of the first and second shredding devices and positioned between the first and second shredding devices, the rotating screening drum configured to permit fluid to pass therethrough while capturing solids on an outer surface for delivery to shredding device, an upstream portion of the rotating screening drum disposed upstream of an upstream portion of the shredding device. The rotating screening drum is configured to rotate clockwise and counter clockwise to alternately distribute solids captured thereon to one of the first and second shredding devices.

According to another aspect, the system may include an interconnect frame for connecting the first shredding device, the second shredding device and the rotating screening drum to the two side walls of the casing. The interconnect frame may be disposed downstream of the rotating screening drum and upstream of both the first shredding device and the second shredding device.

According to another aspect, the system may further include a second rotating screening drum and a third shredding device, the third shredding device aligned along a row with the first and second shredding devices and the second rotating screening drum being disposed upstream and between the second and third shredding devices.

According to another aspect, the system includes a controller configured to control the rotation of the first shredding device, the second shredding and the rotating screening drum. The controller may be configured to alternate a direction of rotation of the rotating screening device periodically to balance loading on the first shredding device and the second shredding device. Additionally, the controller may be configured such that under a normal condition where no jam of either shredding device occurs, the controller rotates each shredding device in a forward direction where the cutting elements between the first and second parallel shafts move in a direction of flow in the casing.

According to another aspect, the controller may be configured to determine whether a jam condition has occurred within one of the first or second shredding devices based on a detected current or power draw of a corresponding motor rotating the corresponding shredding device. The controller may, in response to detecting a jam condition in the one of the first and second shredding devices, reverse the direction of rotation of the one of the first and second shredding devices. Additionally, after rotating the one of the first and second shredding devices for a predetermined period of time in the reverse direction, changes the rotating direction of the one of the first and second shredding devices to the forward direction.

According to another aspect, in response to detecting a jam condition after changing the direction to the forward direction, the controller is configured to reverse the direction of the one of the first and second shredding devices, and after a predetermined period of time passes in the reverse direction, the direction is again reversed to the forward direction to sense whether the jam condition has cleared. Further, in response to a jam condition being sensed multiple times, the controller is configured to transition to a safe mode in which the jammed one of the first and second shredding devices is controlled to operate in a reverse mode and the rotating screening drum is rotated in a direction to move solids to the other of the first and second shredding devices until the safe mode is cleared. The controller may produce an alert that the system is operating in the safe mode.

According to another aspect, in response to the controller determining that a jam condition is sensed multiple times in the other of the first and second shredding devices, the controller transitions from the safe mode to a critical mode in which both the first and second shredding devices are operated in reverse. The controller may produce an alert that the system is operating in the critical mode.

With reference to FIG. 4, a preferred embodiment of the solids diverter and dual comminutor with continual operation consists of the following elements: (i) vertically-oriented rotating screen drum 100; (ii) screen drum top end housing with bearing, seal, shroud and shroud cover 110; (iii) screen drum bottom end housing with bearing, seal, cover and shroud 120; (iv) screen drum drive mechanism 130; (v) two-shafted rotating cutter stack with interlaced cutters and spacers 140; (vi) shredder top end housing with bearings, seals, transfer gear set and cover 150; (vii) shredder bottom end housing with bearings, seals and cover 160; (viii) shredder drive mechanism 170; (ix) an additional two-shafted shredder with features identified in (v) thru (viii); (x) screen drum/shredder interconnect frame 180, and; (xi) screen drum/shredder mounting frames 190 for connection to civil works. The mechanical equipment is controlled by motor controller (FIG. 3) that switches power to the motors 200, 210 (FIG. 4), using a logic controller (FIG. 3) to interpret inputs from load sensors (FIG. 3) and turn outputs on and off in accordance with control logic (FIG. 6), energizing and de-energizing the motor power switches (FIG. 3).

BRIEF DESCRIPTION OF THE DRAWINGS

The above and other features and aspects of the present application will become more apparent by describing non-limiting exemplary embodiments thereof with reference to the attached drawings in which.

DETAILED DESCRIPTION OF THE EXEMPLARY EMBODIMENTS

Figure 4:
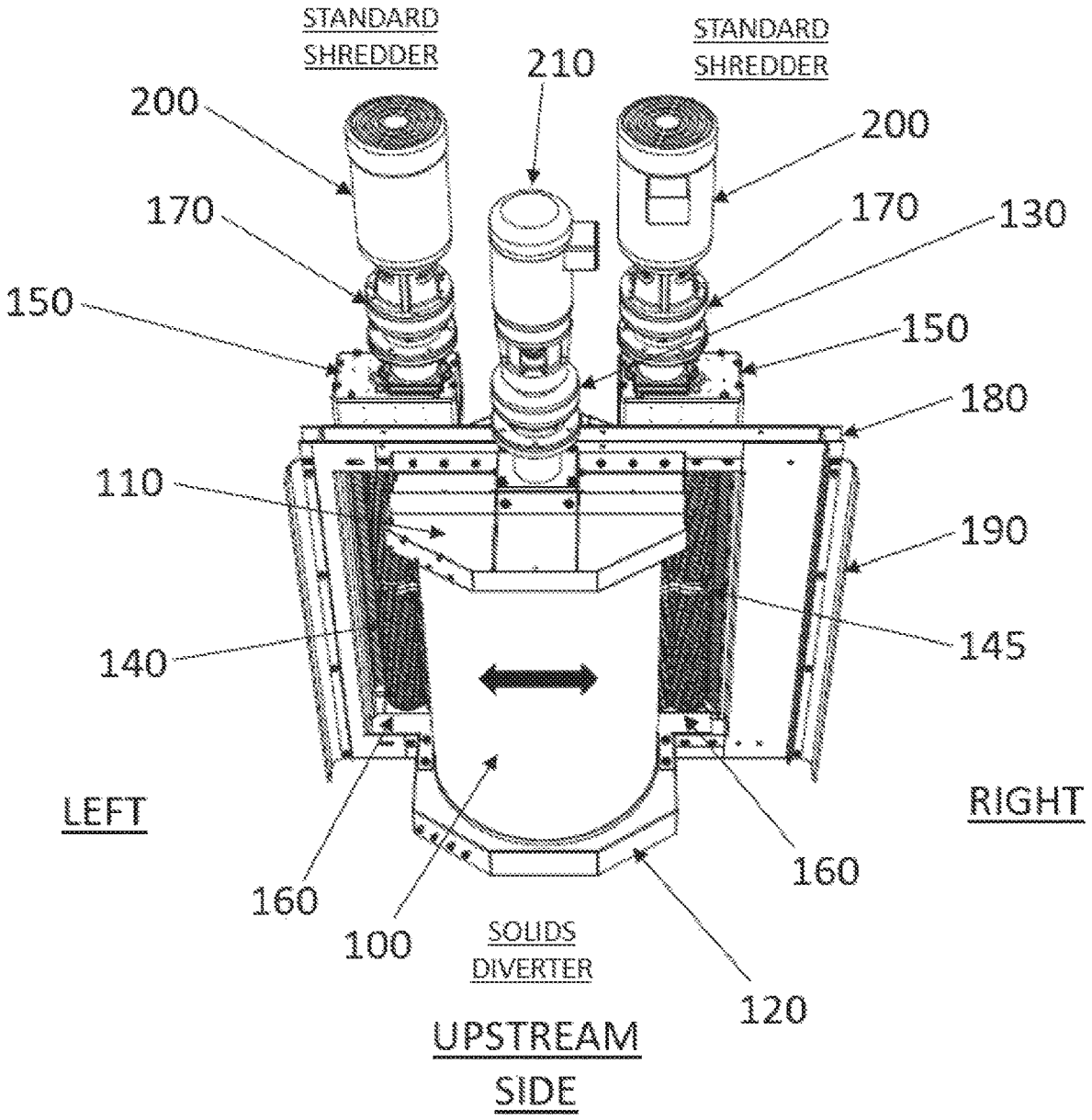
FIG. 4 is an isometric view of a solids diverter and dual, standard shredders.

According to exemplary embodiments described herein, as is generally shown in FIG. 4, a preferred embodiment of the solids diverter and dual comminutor with continual operation consists of the following elements: (i) vertically-oriented rotating screen drum 100; (ii) screen drum top end housing with bearing, seal, shroud and shroud cover 110; (iii) screen drum bottom end housing with bearing, seal, cover and shroud 120; (iv) screen drum drive mechanism 130; (v) two-shafted rotating cutter stack with interlaced cutters and spacers 140; (vi) shredder top end housing with bearings, seals, transfer gear set and cover 150; (vii) shredder bottom end housing with bearings, seals and cover 160; (viii) shredder drive mechanism 170; (ix) an additional twin-shafted shredder with features identified in (v) thru (viii); (x) screen drum/shredder interconnect frame 180, and; (xi) screen drum/shredder mounting frames 190 for connection to civil works.

The solids diverter and dual comminutor is mounted vertically with the drives facing upward and is positioned in a mounting frame, in turn fastened in an open channel, or on an internal wall of a wet well.

The solids diverter is based on a vertically-oriented rotating screen drum 100. The screen drum may be fashioned from perforated plate or sheet metal, wedge wire screen, or similar. The top and bottom ends of the screen drum are fitted with stub shafts supported by bearings retained in end housings 110, 120 (FIG. 4). The end housings may be one-piece elements machined from a cast iron or other metal, welded metal plates and shapes, or other suitable material, or may be hybrid elements consisting of dedicated, structural, seal holding elements, as well as shrouds to inhibit flow under or over the ends of the screen drum. To mitigate the effects of liquid ingress to the bearings, shaft seals are fitted between the shafts and end housings on the wet or process side of the bearings. The top and bottom screen drum end housings are enclosed by covers to maintain a dry side to the shaft support bearings. The top shaft protrudes through the cover on the top end housing 110. The protruding end of the shaft is coupled to a rotational drive mechanism 130 that may be electro-mechanical, hydro-mechanical or other.

Each two-shafted shredder consists of two vertical stacks of interlaced rotary cutters and spacers 140, 145 mounted on adjacent shafts supported by bearings retained in end housings 150, 160 at the top and bottom of the shafts. To mitigate the effects of liquid ingress to the bearings, shaft seals are fitted between the shafts and end housings on the wet or process side of the bearings. Counter-rotation of the shafts is accomplished using a pair of intermeshed, fixed ratio transfer gears mounted on like ends of the shafts. The top and bottom end housings are enclosed by covers to maintain a dry side to the shaft support bearings. Of the two shafts, one is the driving shaft and one is the driven shaft. The top end of the driving shaft protrudes through the cover on the top end housing 150. The protruding end of the shaft is coupled to a rotational drive mechanism 170 that may be electro-mechanical, hydro-mechanical or other. Together, these elements form what may be called the shredder module or shredder.

In the preferred embodiment, both the solids diverter and shredder modules are affixed to an interconnecting frame or tie frame 180. The tie frame is oriented laterally in the channel or mounting frame with the drum module connected to the upstream side or anterior surface of the tie frame and the shredder modules connected to the posterior surface of the frame. The shredder modules are each placed such that the set of cutters in each cutter stack 140, 145 proximal to the screen drum 100 are separated from the drum by a gap small enough to minimize the bypass of solids through the gap but not so close as to allow the cutters to damage the screen drum should the cutter stack shafts deflect while shredding tough objects. The interconnecting frame 180 is configured to form a seal with the portion of the front face of each shredder and the channel or mounting frame 190 to inhibit flow between the screen drum/shredders and the channel walls/mounting frame.

Figure 1:
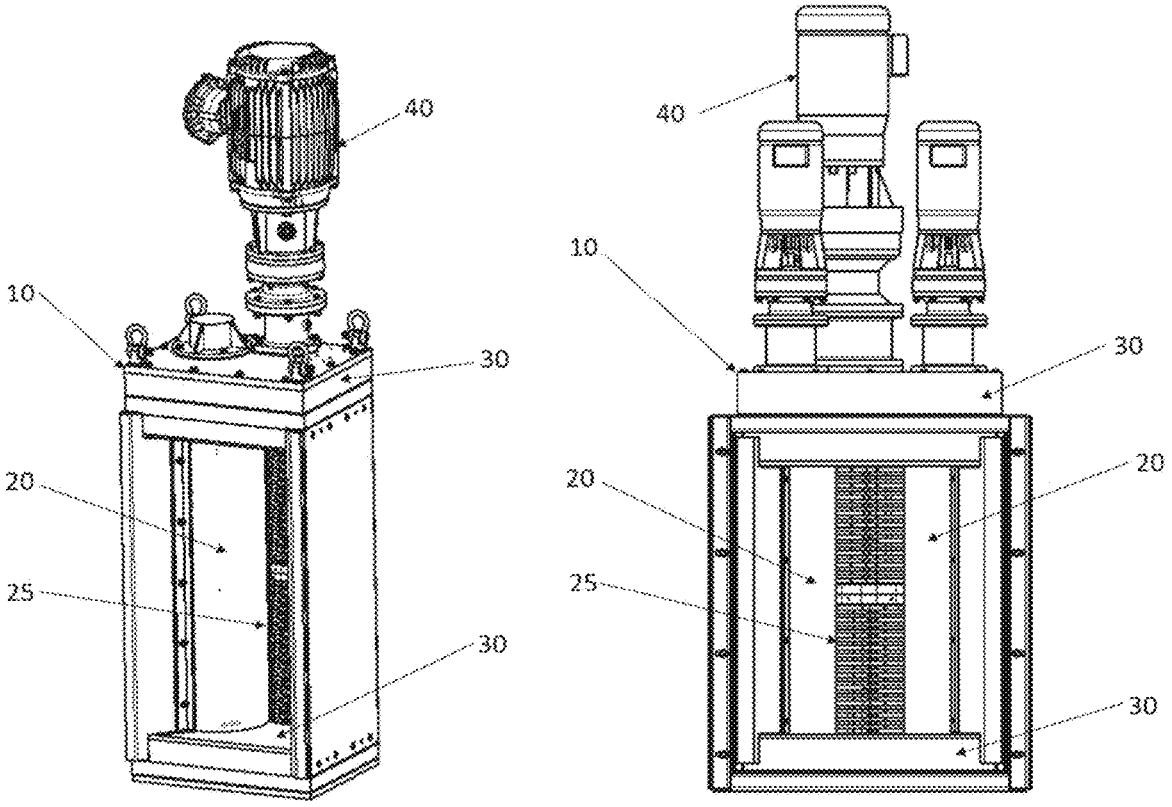
FIG. 1 Prior Art
FIG. 1 presents embodiments of a conventional screen drum comminutor with one and two rotating drums.
Figure 2:
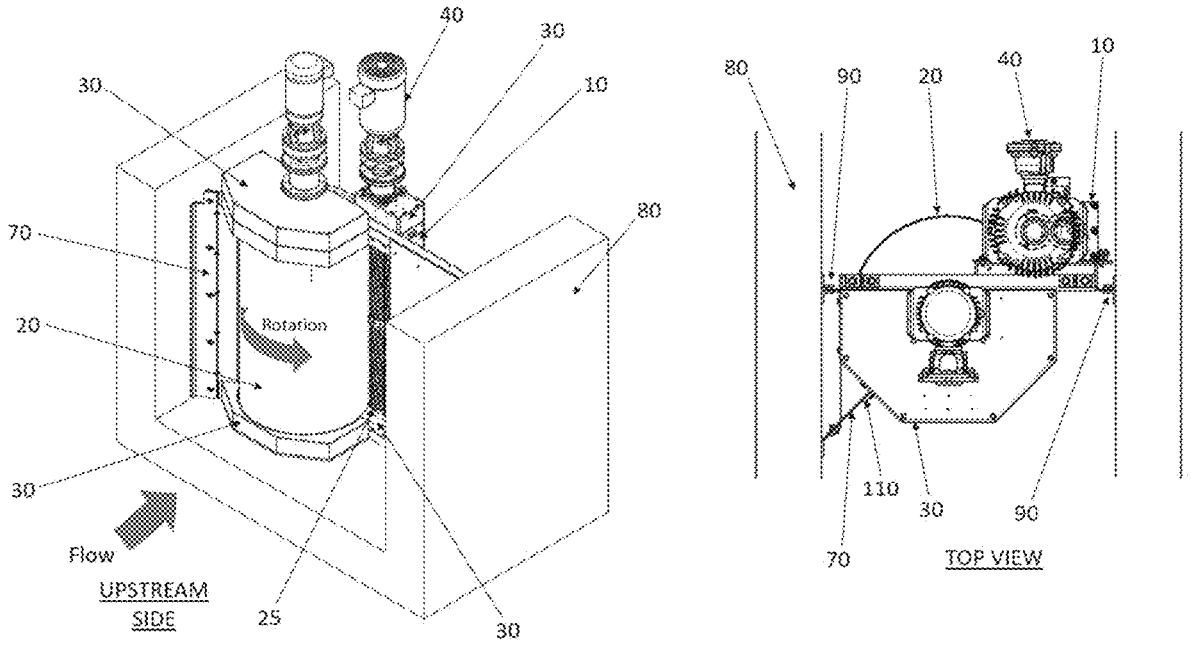
FIG. 2 Related Art
FIG. 2 presents an isometric view and a plan view of a modular twin-shafted shredder with solids diverter.
Figure 3:
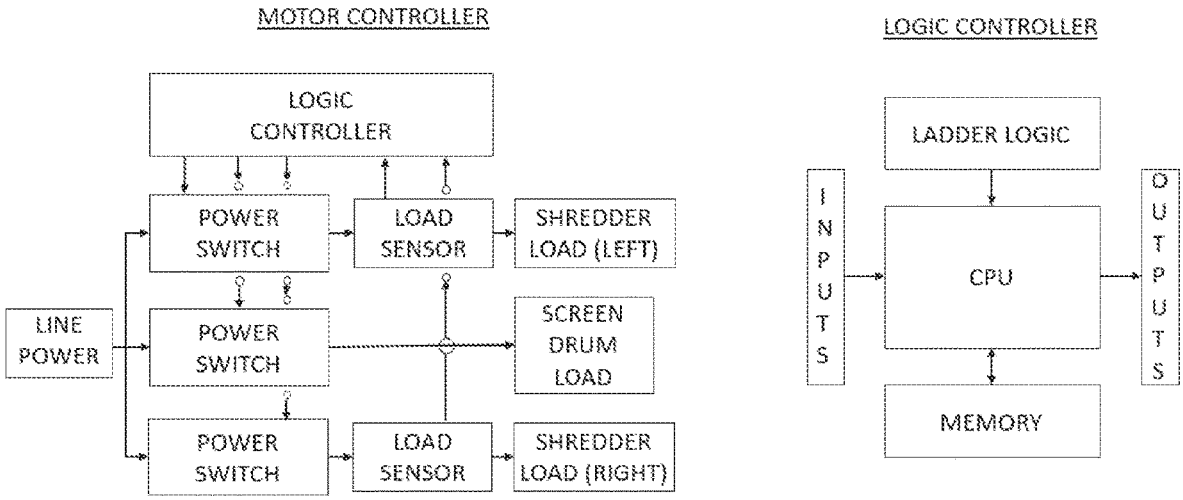
FIG. 3 shows block diagrams of a motor controller with logic controller, and a logic controller.

The mechanical equipment is controlled by motor controller (FIG. 3) that switches power to the motors 200, 210 (FIG. 4), using a logic controller (FIG. 3) to interpret inputs from load sensors (FIG. 3) and turn outputs on and off in accordance with control logic (FIG. 6), energizing and de-energizing the motor power switches (FIG. 3).

Figure 5:
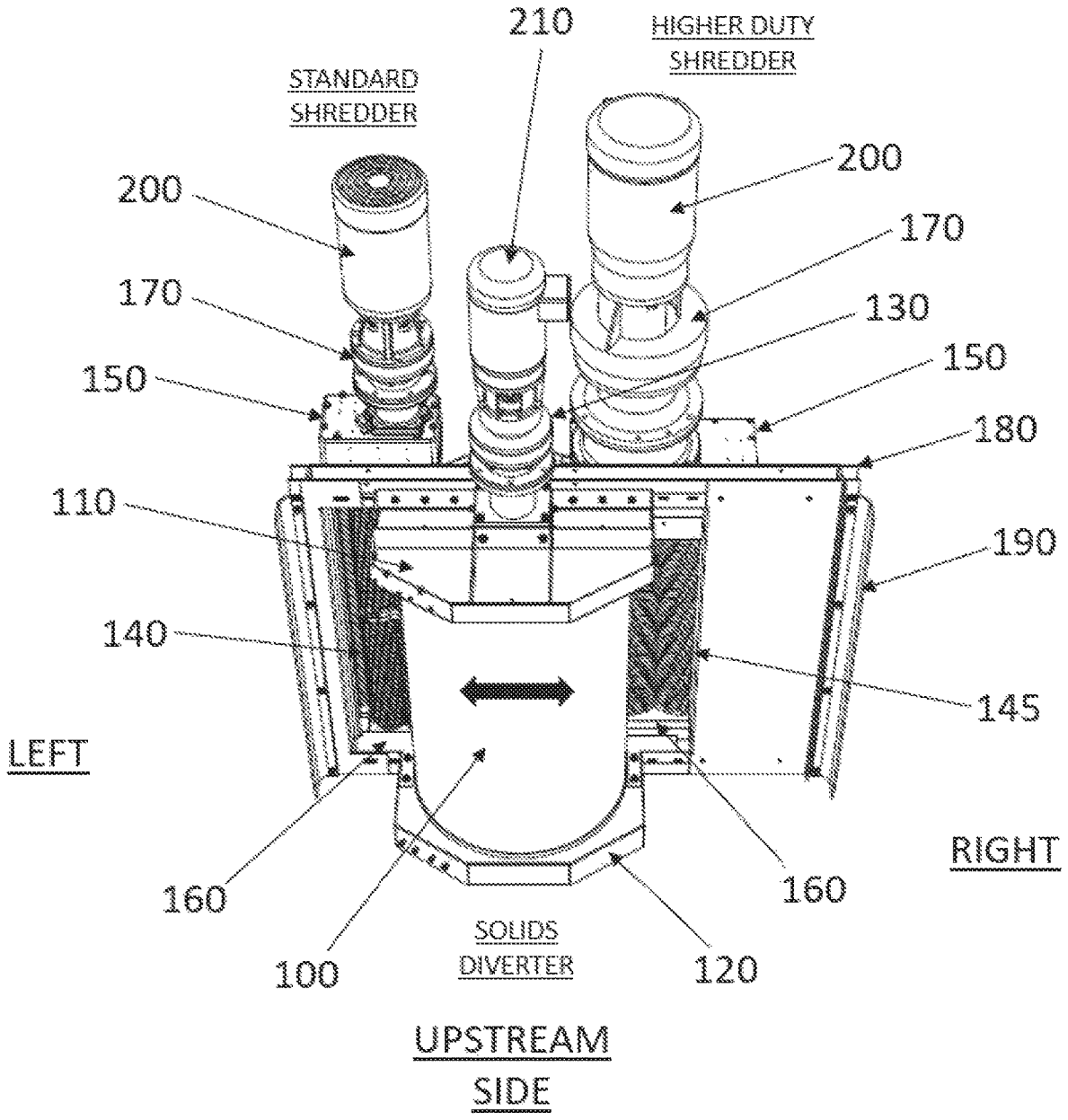
FIG. 5 is an isometric view of a solids diverter, standard shredder and higher duty shredder.

In the preferred embodiment, the two shredder modules are of like sizes and capacities or "standard" shredders (FIG. 4). However, in another embodiment, one of the shredder modules may be standard while the other shredder module may be a "higher duty" shredder (FIG. 5). In this embodiment, the higher duty shredder may be positioned on the left side of the screen drum, or on the right side of the screen drum.

In an additional embodiment, the basic configurations illustrated in FIG. 4 and FIG. 5 may be flanked on the left side or the right side by one or more additional screen drum+shredder combinations to form a chain of alternating shredders and screen drums.

Further embodiments are envisioned wherein the interconnect frame or tie frame 180 (FIG. 4, FIG. 5) is eliminated in favor of another interconnect mechanism that provides suitable structural connection between the individual screen drum and shredder modules. This alternate interconnect mechanism may include: (i) some form of interconnecting keys, (ii) common top and bottom end housings, or similar.

Figure 6:
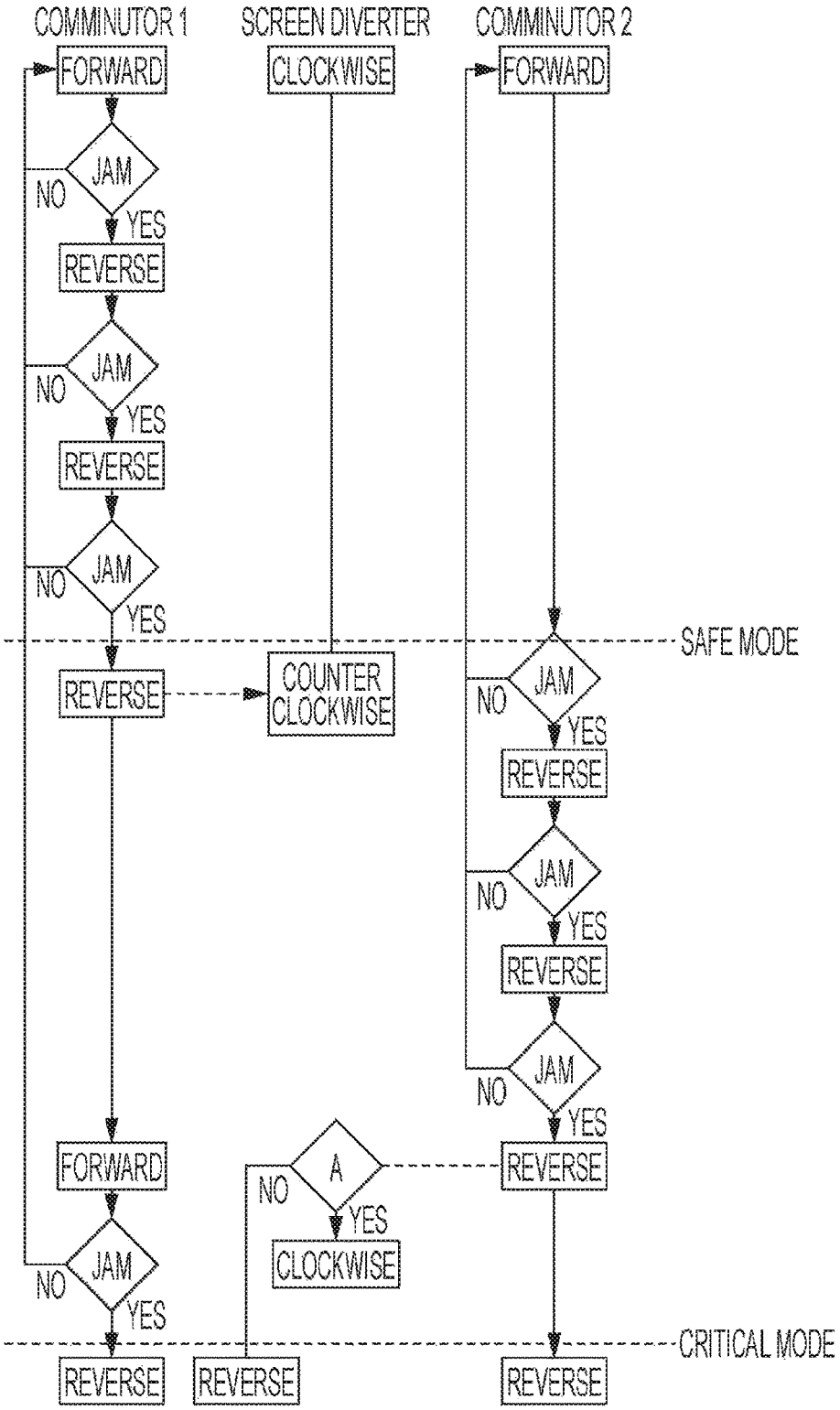
FIG. 6 is a flow chart depicting the decision tree of the control logic implemented in the motor controller of the preferred embodiment.

During operation, the solids diverter with dual comminutor generally behaves in the following manner: the solids diverter (FIG. 4) operates such that the face of the screen drum moves either from left to right, or from right to left (when viewed from the upstream side of the shredder); the left cutter stack 140 operates in its forward direction allowing it to receive and shred materials transported to it by the solids diverter screen drum 100 and directly from the waste stream, and the right cutter stack 145 operates in its forward direction allowing it to receive and shred materials transported to it by the solids diverter screen drum and directly from the waste stream. The direction of operation of the solids diverter may be alternated by the logic controller (FIG. 3) for balanced shredder loading. When the left shredder receives tough solids that cause it to jam, the logic controller causes the solids diverter to change direction to transport captured solids to the right shredder. At approximately the same time, the logic controller will attempt to clear the left shredder jam in accordance with the ladder logic (FIG. 6). If the jam cannot be cleared, the left shredder will be energized in its reverse direction ("safe mode", FIG. 6) and a suitable alert will be annunciated for action by facility personnel. Conversely, when the right shredder receives tough solids that cause it to jam, the logic controller causes the solids diverter to change direction to transport captured solids to the left shredder. The logic controller will attempt to clear the jam in the right shredder. If the jam cannot be cleared, the right shredder will be energized in its reverse direction ("safe mode", FIG. 6) and a suitable alert will be annunciated for action by facility personnel. The benefit to this capability is that the likelihood of a jam-related fault condition, that may result in an overflow event, is reduced by a factor of two. Furthermore, if one of the two shredders has a higher duty rating (FIG. 5), with greater shredding capability than the other, the likelihood of an overflow event is yet further reduced. This is especially advantageous when dealing with a combined sewer overflow (CSO) application where overflow storm water combines with sewer flows. During storm water overflow conditions, the system may be operated to prefer the higher duty rating shredder.

The possibility exists that both the left and right shredders are incapable shredding certain tough solids at the same time. This might occur when solids, exemplified by significant quantity of wire rope, several articles of clothing, or possibly a fishing net, are presented to the shredder. In such case, both shredders may be placed in safe mode at the same time. This condition would result in an elevated fault condition ("critical mode", FIG. 6) and a suitably-urgent alert annunciated for facility personnel.

What is claimed is:

1. A system for comminuting solid waste material comprising:

a casing defining a comminution chamber having two side walls and being open on opposite sides thereof for permitting the flow of liquid therethrough bearing solid waste material and being adapted for connection in a solid waste disposal channel;

a first shredding device and a second shredding device disposed along a line extending perpendicular to a flow direction in the channel;

each of the first and second shredding devices comprising parallel first and second shredding stacks that include first and second rotating parallel shafts, the first and second rotating parallel shafts including a plurality of cutting elements mounted in an interspaced relationship such that the cutting elements on the first rotating parallel shaft are interleaved with the cutting elements on the second rotating parallel shaft, each of said cutting elements having at least one cutting tooth thereon, said cutting elements being positioned between and separated in an axial direction by spacers which are coplanar with the cutting elements of the adjacent shredding stack such that a cutting element from one shredding stack and a spacer from the other shredding stack form a pair of interactive shredding members;

a rotating screening drum disposed within the casing upstream of the first and second shredding devices and positioned between the first and second shredding devices, the rotating screening drum configured to permit fluid to pass therethrough while capturing solids on an outer surface for delivery to at least one of the first and second shredding devices, an upstream portion of the rotating screening drum disposed upstream of an upstream portion of the shredding device, wherein the rotating screening drum is configured to rotate clockwise and counter clockwise to alternately distribute solids captured thereon to one of the first and second shredding devices.

2. The system for comminuting solid waste material according to claim 1, further comprising an interconnect frame for connecting the first shredding device, the second shredding device and the rotating screening drum to the two side walls of the casing.

3. The system for comminuting solid waste material according to claim 2, wherein the interconnect frame is disposed downstream of the rotating screening drum and upstream of both the first shredding device and the second shredding device.

4. The system for comminuting solid waste material according to claim 1, wherein the rotating screening drum is connected to each of the first shredding device and the second shredding device.

5. The system for comminuting solid waste material according to claim 1, further comprising a controller configured to control the rotation of the first shredding device, the second shredding device and the rotating screening drum.

6. The system for comminuting solid waste material according to claim 5, wherein the controller is configured to alternate a direction of rotation of the rotating screening device periodically to balance loading on the first shredding device and the second shredding device.

7. The system for comminuting solid waste material according to claim 5, wherein under a normal condition where no jam of either shredding device occurs, the controller rotates each shredding device in a forward direction where the cutting elements between the first and second parallel shafts move in a direction of flow in the casing.

8. The system for comminuting solid waste material according to claim 7, wherein the controller is configured to determine whether a jam condition has occurred within one of the first or second shredding devices based on a detected current or power draw of a corresponding motor rotating the corresponding shredding device.

9. The system for comminuting solid waste material according to claim 8, wherein the controller is configured, in response to detecting the jam condition in the one of the first and second shredding devices, reverses a direction of rotation of the one of the first and second shredding devices to a reverse direction.

10. The system for comminuting solid waste material according to claim 9, wherein after rotating the one of the first and second shredding devices for a predetermined period of time in the reverse direction, changes the direction of rotation of the one of the first and second shredding devices to the forward direction.

11. The system for comminuting solid waste material according to claim 10, wherein in response to detecting the jam condition after changing the direction to the forward direction, the controller is configured to reverse the direction of rotation of the one of the first and second shredding devices, and after a predetermined period of time passes in the reverse direction, the direction is again reversed to the forward direction to sense whether the jam condition has cleared.

12. The system for comminuting solid waste material according to claim 11, in response to the jam condition being sensed multiple times, the controller is configured to transition to a safe mode in which the jammed one of the first and second shredding devices is controlled to operate in a reverse mode and the rotating screening drum is rotated in a direction to move solids to the other of the first and second shredding devices until the safe mode is cleared.

13. The system for comminuting solid waste material according to claim 12, wherein the controller is configured to produce an alert that the system is operating in the safe mode.

14. The system for comminuting solid waste material according to claim 12, wherein in response to it being determined that a jam condition is sensed multiple times in the other of the first and second shredding devices, the controller transitions from the safe mode to a critical mode in which both the first and second shredding devices are operated in reverse.

15. The system for comminuting solid waste material according to claim 14, wherein the controller is configured to produce an alert that the system is operating in the critical mode.

* * * * *